US008675817B2

(12) United States Patent
Ogata et al.

(10) Patent No.: US 8,675,817 B2
(45) Date of Patent: Mar. 18, 2014

(54) INDUSTRIAL X-RAY GENERATOR

(75) Inventors: Kiyoshi Ogata, Minato-ku (JP); Tetsuo Kani, Yokohama (JP); Makoto Kanbe, Fussa (JP); Yoshihiro Takeda, Ome (JP); Takahisa Sato, Higashiyamato (JP)

(73) Assignee: Rigaku Corporation, Akishima-Shi, Tokyo (JP)

( * ) Notice: Subject to any disclaimer, the term of this patent is extended or adjusted under 35 U.S.C. 154(b) by 424 days.

(21) Appl. No.: 13/194,430

(22) Filed: Jul. 29, 2011

(65) Prior Publication Data

US 2012/0027179 A1 Feb. 2, 2012

(30) Foreign Application Priority Data

Jul. 30, 2010 (JP) ..... 2010-172710

(51) Int. Cl.
*H05G 1/10* (2006.01)

(52) U.S. Cl.
USPC ..... 378/101; 378/119; 378/121

(58) Field of Classification Search
USPC ..... 378/101, 111, 112, 119–121
See application file for complete search history.

(56) References Cited

FOREIGN PATENT DOCUMENTS

| | | | |
|---|---|---|---|
| JP | 3-149740 | A | 6/1991 |
| JP | 6-267692 | A | 9/1994 |
| JP | 2001-135496 | A | 5/2001 |
| JP | 2001-135497 | A | 5/2001 |

*Primary Examiner* — Courtney Thomas
(74) *Attorney, Agent, or Firm* — Buchanan Ingersoll & Rooney PC

(57) ABSTRACT

An X-ray generator includes a booster circuit formed by sequentially connecting a plurality of boosting steps extending from a low-voltage terminal to a high-voltage terminal of its own.

The booster circuit is arranged in a lateral region of the X-ray tube so as to make the low-voltage terminal of its own correspond to the anode of the X-ray tube and the high-voltage terminal of its own correspond to the cathode of the X-ray tube. A lead wire extending from the cathode to the outside of the X-ray tube is connected to the high-voltage terminal of the booster circuit. A molded member containing insulating resin is formed to shield at least a cathode side end part of the X-ray tube, the lead wire outwardly extending from the cathode side end part and a high-voltage terminal side end part of the booster circuit.

20 Claims, 14 Drawing Sheets

INDUSTRIAL X-RAY GENERATOR

BACKGROUND OF THE INVENTION

1. Field of the Invention

The present invention relates to an industrial X-ray generator designed to drive electrons emitted from a cathode to hit an anode and thereby generate X-rays from the anode so as to be used for non-destructive examinations of structures such as pipes of plant piping.

2. Description of the Related Art

X-ray generators having a cathode formed by using a tungsten filament as electron source are known. For example, Jpn. Pat. Appln. Laid-Open Publication No. 6-267692 (Patent Document 1) discloses such an X-ray generator. Generally, the filament is electrically energized and heated to not lower than 2,000° C. in order to make it emit thermal electrons. A high voltage is applied to the filament. Therefore, when an X-ray tube and an X-ray power source are arranged in a single unit for an industrial X-ray tube, the X-ray tube and the X-ray power source are sealed in high-pressure gas containers in order to establish insulation. For example, Jpn. Pat. Appln. Laid-Open Publication No. 3-149740 (Patent Document 2) discloses such a technique.

Conventional industrial X-ray generators using high-pressure gas containers are accompanied by a problem of bulkiness and heavyweight because high-pressure containers have to be used. An X-ray generator and a control unit typically weigh about 30 kg when put together.

Industrial X-ray generators having a cathode formed by using a filament require an arrangement for cooling the power source for filament and also the filament section to give rise to a problem of being large and heavy.

Industrial X-ray generators designed to use a molded member for electrically insulating the high-voltage section thereof instead of using gas for insulation are also known. For example, Jpn. Pat. Appln. Laid-Open Publication No. 6-267692 (Patent Document 3), Jpn. Pat. Appln. Laid-Open Publication No. 2001-135496 (Patent Document 4) and Jpn. Pat. Appln. Laid-Open Publication No. 2001-135497 (Patent Document 5) disclose such X-ray generators.

However, Jpn. Pat. Appln. Laid-Open Publication No. 6-267692 (Patent Document 3) only discloses an apparatus where only a cable receptacle and an X-ray tube are covered by a molded member and hence it does not provide a compact and lightweight insulated structure where both a high-voltage section and an X-ray tube are covered by a molded member.

Jpn. Pat. Appln. Laid-Open Publication No. 2001-135496 (Patent Document 4) and Jpn. Pat. Appln. Laid-Open Publication No. 2001-135497 (Patent Document 5) disclose apparatus where an X-ray tube and a high-voltage generating section are arranged at mutually unrelated respective positions and the high-voltage generating section is electrically insulated by a molded member.

Since an X-ray tube and a high-voltage generating section are arranged at mutually unrelated respective positions in each of these known apparatus, the entire apparatus including an X-ray tube and a high-voltage generating section inevitably becomes large.

Additionally, while a high-voltage generating section is so designed that a low voltage of about several kV is applied to its input terminal and it outputs a high voltage of tens of several kV to a hundred and tens of several kV from its output terminal, no appropriate consideration is given to the positional arrangement of the high-voltage site and the low-voltage site in either of the apparatus disclosed in Jpn. Pat. Appln. Laid-Open Publication No. 2001-135496 (Patent Document 4) and Jpn. Pat. Appln. Laid-Open Publication No. 2001-135497 (Patent Document 5). In other words, a sufficient distance needs to be provided between the high-voltage site and the low-voltage site and the molded member for shielding the high-voltage section requires a sufficient size and a sufficient volume to make any attempt at downsizing a difficult one.

Generally, in X-ray generators having an X-ray tube, industrial X-ray generators in particular, the X-ray tube and the high-voltage generating section need to be covered by an X-ray shielding member that is typically made of lead in order to prevent X-rays from leaking to the outside. As the X-ray generator becomes large, the X-ray shielding member also becomes large. Then, there arises a problem that the entire apparatus becomes very heavy due to the lead it contains.

SUMMARY OF THE INVENTION

In view of the above-identified problems of the known apparatus, it is therefore the object of the present invention to provide an industrial X-ray generator that can be downsized and hence made lightweight and ensure a satisfactory level of insulation by means of a molded member formed by using a small amount of material by selecting appropriate positions for an X-ray tube and a high-voltage generating section, considering the positional relationship between them.

An industrial X-ray generator according to the present invention includes:

an X-ray tube that stores a cathode for emitting electrons and an anode for attracting electrons in a tubular body thereof;

an X-ray shielding member that is made of a substance mainly containing an element of an atomic number not smaller than 55 and hardly allowing X-rays to pass through the substance and covers the X-ray tube;

a booster circuit that generates a high voltage to be applied to the cathode;

the anode being grounded, the booster circuit being formed by sequentially connecting a plurality of boosting steps extending from a low-voltage terminal to a high-voltage terminal of its own, the booster circuit being arranged in a lateral region of the X-ray tube so as to make the low-voltage terminal of its own correspond to the anode of the X-ray tube and the high-voltage terminal of its own correspond to the cathode of the X-ray tube, an electroconductive member extending from the cathode to the outside of the X-ray tube and connected to the high-voltage terminal of the booster circuit; and a molded member containing insulating resin and formed to shield at least a cathode side end part of the X-ray tube, the electroconductive member extending from the cathode side end part and at least a high-voltage terminal side end part of the booster circuit.

Thus, in an industrial X-ray generator according to the present invention, the high-voltage terminal of the X-ray tube and the high-voltage terminal of the booster circuit are arranged adjacently relative to each other. Therefore, the electroconductive member (e.g., a lead wire or a bus bar) for connecting the terminals can be made short. As a result, the region of the molded member for insulating the electroconductive member becomes very small so that the industrial X-ray generator can be made compact and lightweight.

Since the molded member is small, the X-ray shielding member that covers the molded member can be made small. An X-ray shielding member is normally made of lead and hence heavy. However, according to the present invention, the X-ray shielding member can be downsized and hence the quantity of lead can be reduced to make the X-ray shielding member lightweight.

Additionally, since the region of the molded member is small, the X-ray shielding member that covers the molded member can be made small. Normally an X-ray shielding member is made of lead and hence heavy. However, according to the present invention, the X-ray shielding member can be downsized and hence the quantity of lead can be reduced to make the member lightweight.

An industrial X-ray generator according to the present invention may further have a transformer circuit including piezoelectric transformers for supplying electric power to the low-voltage terminal of the booster circuit and a power supply driver for supplying AC power of a frequency suited to the piezoelectric transformers to the transformer circuit. With this arrangement, both the weight and the volume of an industrial X-ray generator can be reduced if compared with industrial X-ray generators having an electromagnetic transformer.

In an industrial X-ray generator according to the present invention, the power supply driver and the transformer circuit are desirably arranged near the anode side end part of the X-ray tube. This is because the power supply driver and the transformer circuit deal with a low voltage and hence it is better to arrange them at the low-voltage side of the X-ray tube.

An industrial X-ray generator according to the present invention may further include a controller for controlling the operation of the booster circuit, that of the transformer circuit and that of the power supply driver and the transformer circuit is arranged adjacently relative to the controller.

An industrial X-ray generator according to the present invention may further include a base for mounting the X-ray tube and the power supply driver is mounted on the base while the transformer circuit is mounted on the power supply driver and the controller is arranged on the transformer circuit.

With this arrangement, the lead contained in the piezoelectric transformer of the transformer circuit shields X-rays directed to the controller to prevent the controller from operating erroneously. Additionally, as the piezoelectric transformer is arranged as an X-ray shielding element, an X-ray shield such as a lead plate can be eliminated accordingly to reduce the weight of the X-ray generator.

An industrial X-ray generator according to the present invention may further include a battery for applying a voltage to the power supply driver and the battery is desirably arranged on the base at a position near the anode side end part of the X-ray tube.

In an industrial X-ray generator according to the present invention, the booster circuit is desirably a Cockcroft-Walton circuit. Then, a desired high voltage can be obtained with a simple arrangement.

The molded member desirably contains an oxide of an element of an atomic number not smaller than 55, or a so-called heavy metal oxide, as filler. Then, X-rays can be shielded by the material for molding.

The thermal conductivity of the molded member is desirably not less than 10 W/(m·K). Then, it is possible to prevent heat from being accumulated in the industrial X-ray generator and the X-ray generator from becoming unnecessarily hot.

In an industrial X-ray generator according to the present invention, the cathode desirably emit electrons on the basis of field emission. Then, the industrial X-ray generator can be downsized and made lightweight if compared with an arrangement of using a thermal electron emission type electron emitting element that employs a filament.

DESCRIPTION OF THE PREFERRED EMBODIMENTS (First Embodiment of Industrial X-Ray Generator)

Now, embodiments of industrial X-ray generator according to the present invention will be described below. It may not be necessary to say that the present invention is by no means limited to those embodiments. While the drawings are referred to in the following description, components of apparatus may be illustrated with dimensional proportions that are different from the real ones for the purpose of illustrating characteristic parts of the embodiments in an easily understandable fashion.

Figure 1:
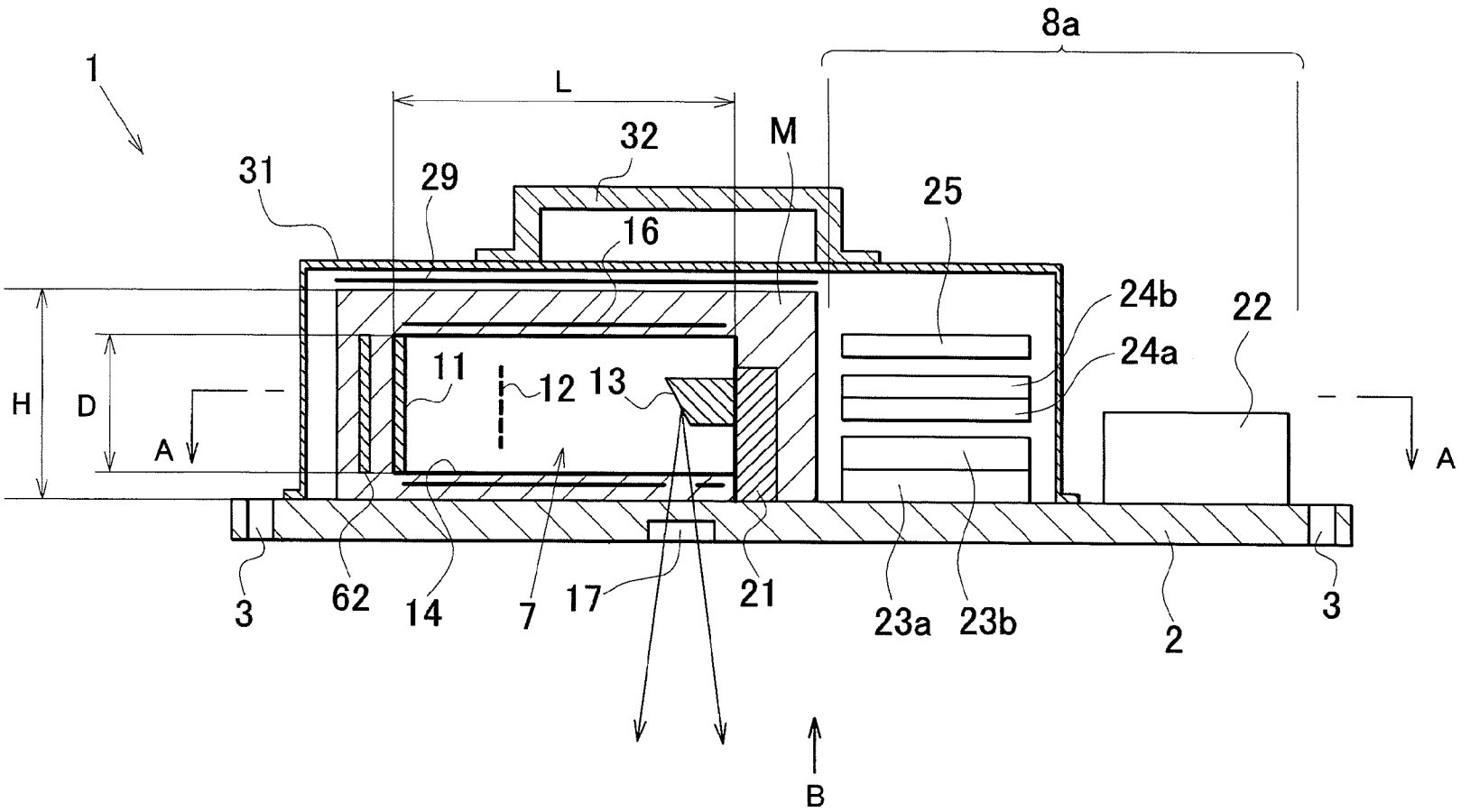
FIG. 1 is a schematic front view of an embodiment of industrial X-ray generator according to the present invention.
Figure 2:
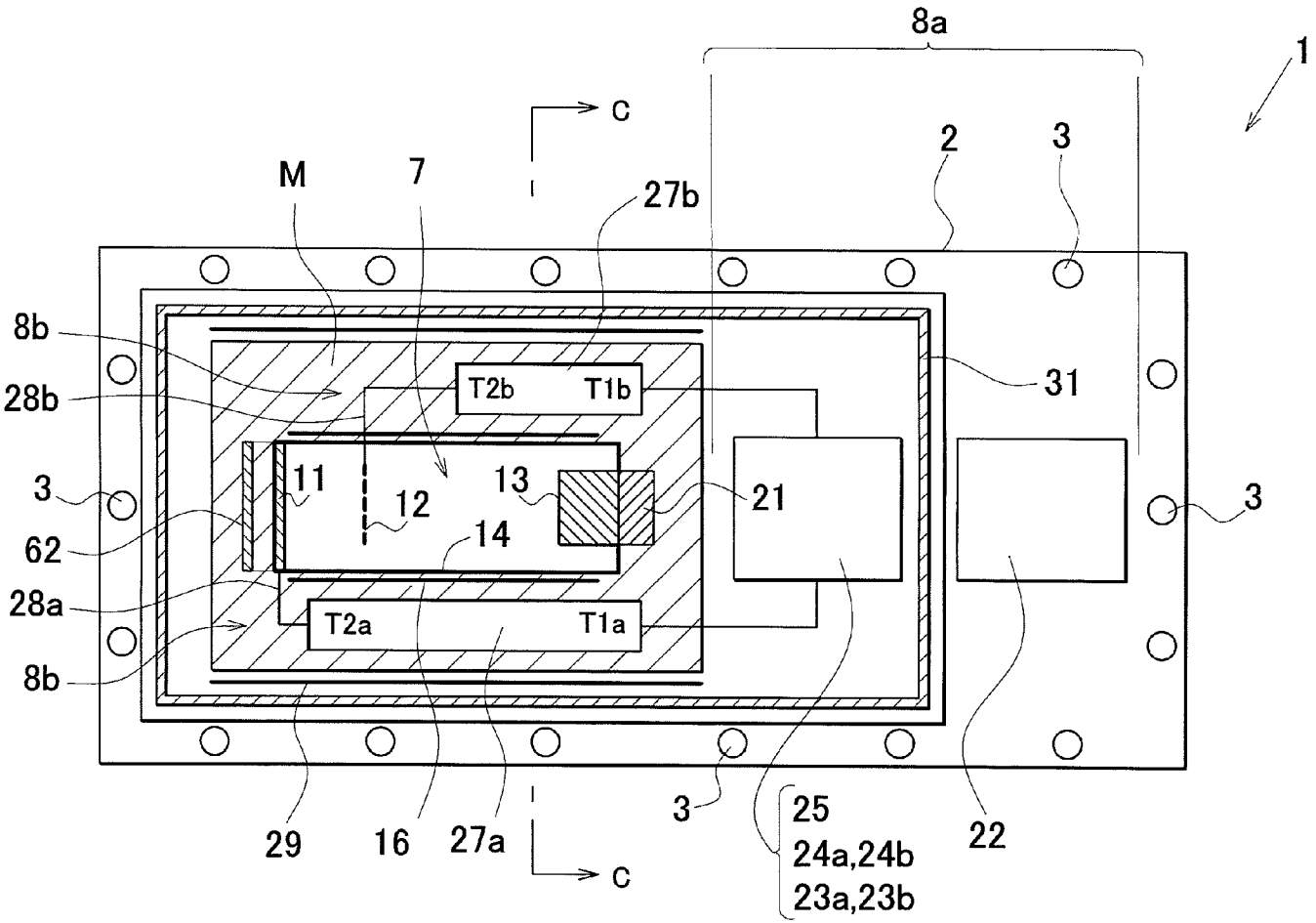
FIG. 2 is a schematic cross-sectional plan view taken along line A-A in FIG. 1.
Figure 3:
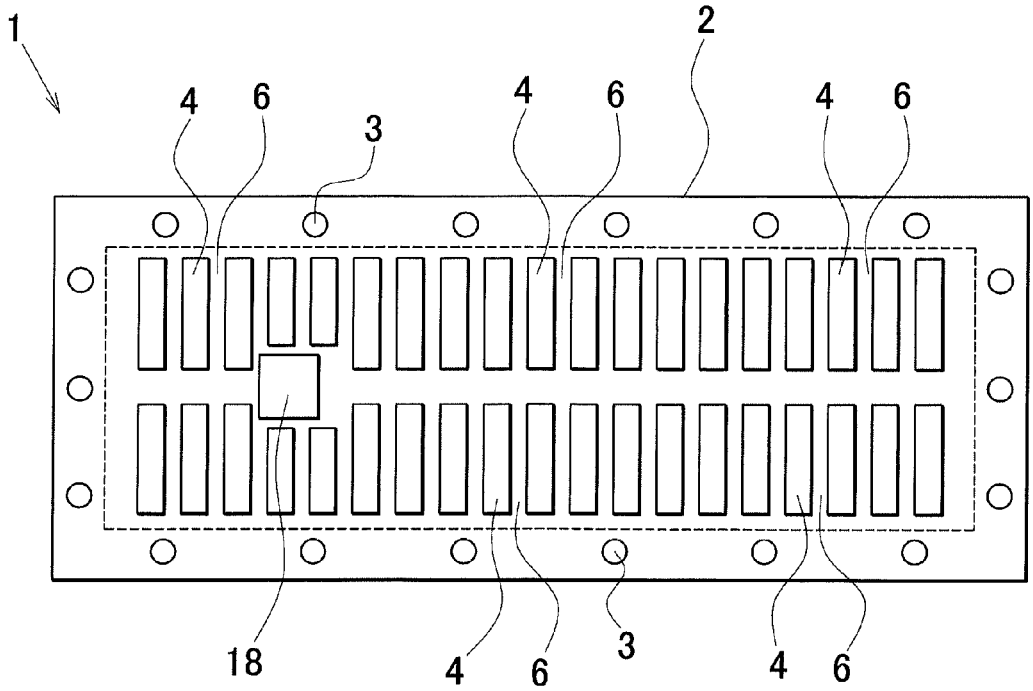
FIG. 3 is a schematic bottom view of the industrial X-ray generator as viewed in the direction of arrow B in FIG. 1.
Figure 4A:
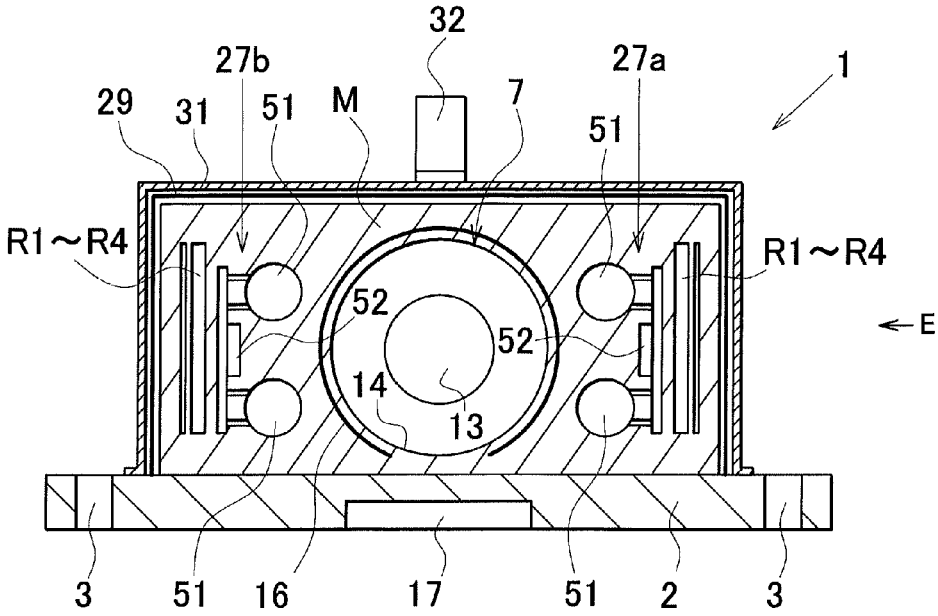
FIG. 4A is a schematic cross-sectional lateral view taken along line C-C in FIG. 2

FIG. 1 is a schematic longitudinal cross-sectional front view of an embodiment of industrial X-ray generator according to the present invention. FIG. 2 is a schematic cross-sectional plan view taken along line A-A in FIG. 1. FIG. 3 is a schematic bottom view of the industrial x-ray generator as viewed in the direction of arrow B in FIG. 1. FIG. 4A is a schematic cross-sectional lateral view taken along line C-C in FIG. 2, showing the short-side direction of the industrial X-ray generator.

Referring to the drawings, the industrial X-ray generator 1 has an oblong rectangular base 2. The base 2 is made of a thermally highly conductive material such as Al (aluminum).

The base 2 is provided along its peripheral edges with a plurality of fitting holes 3 for receiving a supporting member, e.g., a wire, for supporting a two-dimensional X-ray detector, which will be described hereinafter. As shown in FIG. 3, a large number of linear grooves 4 are formed on the bottom surface of the base 2 and a large number of flat intra-planar radiation fins 6 are arranged among the grooves 4 in two rows.

Referring to FIG. 1, an X-ray tube 7 is arranged on the base 2. The X-ray tube 7 includes a cylindrical tubular body 14. A cathode 11 for emitting electrons, a grid 12 that is an extraction electrode and an anode 13 for attracting electrons are arranged in the inside of the tubular body 14. As electrons collide with the anode 13, it generates X-rays. In other words, the anode 13 is a member that operates as target. The energy level of the generated white X-rays, or the wavelength of the generated white X-rays is determined by the acceleration voltage that is applied between the anode 13 and the cathode 11. Furthermore, the energy level of the generated characteristic X-rays is also determined by the material of the anode 13.

The cathode 11 emits electrons on the basis of field emission.

Field emission is a phenomenon where electrons are emitted from a surface of a substance when a strong potential is applied to the surface of the substance. Substances containing carbon nanotubes and substances containing graphite particles are known as substances that can emit electrons by field emission to an amount sufficient for practical applications.

Carbon nanotubes are needle-shaped tubular particles consisting of a six-carbon ring and hence showing a very high aspect ratio (particle length/particle diameter). Graphite particles are a substance containing graphite. Graphite is a substance having a laminate-structure in which a number of carbon hexagonal planes (in each of which a plurality of six-carbon rings are linked to form a layer) are laid one on the other.

A cylindrical magnetic shielding member 16 that is made of ferrite is arranged around the X-ray tube 7. The magnetic shielding member 16 prevents the magnetic field excited by the electric current that flows around the tubular body 14 from influencing the electron rays in the inside of the X-ray tube 7.

The cylindrical magnetic shielding member 16 is arranged around the outer periphery of the tubular body 14 of the X-ray tube 7 as shown in FIG. 4A. A magnetic shield is required to have a high magnetic permeability, a small coercive force and a highly electrically insulating property. Manganese zinc ferrite ((Mn, Zn) $Fe_3O_4$) is employed in this embodiment.

The magnetic shielding member 16 is made to have an opening at a position located at a side of the anode 13 and opposite to the base 2 and the corresponding part of the base 2 is made thin by machining. A region 17 for taking out the X-rays generated at the anode 13 to the outside is formed by the opening and the thin part. The base 2 has a thickness of 10 mm, for example, and the thickness of the thin part is 5 mm, for example.

A thermal conductor 21 that is made of a material having a high thermal conductivity such as Al (aluminum) or Cu (copper) is arranged on the surface of the base 2 and the anode 13 is bonded to the thermal conductor 21. They are bonded together typically by metallizing (a process of producing metal) or soldering.

In this embodiment, the anode 13 is electrically grounded and the cathode 11 is made to show a high negative voltage (an arbitrary voltage within a range between −80 kV and −200 kV). Since the anode 13 is grounded, the electric stability of the anode 13 is ensured when the thermal conductor 21 is brought into contact with the anode 13. The anode 13 is securely fixed to the base 2 by the terminal conductor 21. The temperature of the anode 13 rises high as electrons are made to collide with the anode 13. However, heat flows from the anode 13 to the base 2 by way of the thermal conductor 21 so that the anode 13 is efficiently cooled and prevented from being damaged by heat. The cathode 11 shows a high voltage and does not emit heat. Therefore, the cathode 11 is not rigidly secured to the base 2.

A high-voltage power supply section is arranged in region 8*a* outside the anode side end part of the X-ray tube 7 on the base 2 in FIG. 1 and in region 8*b* at the opposite lateral sides of the X-ray tube 7 on the base 2 in FIG. 2. The high-voltage power supply section of this embodiment includes a lithium ion battery 22, power supply drivers 23*a* and 23*b*, transformer circuits 24*a* and 24*b* and a controller 25 arranged in the region 8*a* of FIG. 1 along with booster circuits 27*a* and 27*b* arranged respectively in the lateral regions 8*b* in FIG. 2. The circuit configuration of this high-voltage power supply section will be described hereinafter.

The lithium ion battery 22, the power supply driver 23*a*, the transformer circuit 24*a* and the booster circuit 27*a* form a high-voltage power supply section for applying a high voltage to the cathode 11. A negative high voltage that may typically be −200 kV is applied to the cathode 11. The lithium ion battery 22, the power supply driver 23*b*, the transformer circuit 24*b* and the booster circuit 27*b* form a high voltage power supply section for applying a high voltage to the grid 12. A negative high voltage that may typically be −100 kV is applied to the grid 12.

As will be described in greater detail hereinafter, each of the booster circuits 27*a*, 27*b* in FIG. 2 shows an oblong outer profile extending along the longitudinal direction of the X-ray tube 7. The terminal sections T1*a*, T1*b* at the anode 13 side of these circuits are input terminal sections for receiving low voltages as input. The terminal sections T2*a*, T2*b* at the cathode 11 side of these circuits are output terminal sections for outputting a high voltage. A voltage of about 4 to 10 kV is applied to each of the input terminal sections T1*a*, T1*b* of the booster circuits 27*a*, 27*b* as input and −200 kV is output to the output terminal T2*a* of the booster circuit 27*a* for the cathode, while −100 kV is output to the output terminal T2*b* of the booster circuit 27*b* for the grid.

Referring to FIG. 2, lead wire 28*a* extending from the cathode 11 as an electroconductive member at the cathode 11 side end part of the X-ray tube 7 runs out of the X-ray tube 7 so as to be connected to the output terminal T2*a* of the booster circuit 27*a* for the cathode.

On the other hand, lead wire 28*b* extending from the grid 12 as an electroconductive member runs out of the X-ray tube 7 so as to be connected to the output terminal T2*b* of the booster circuit 27*b* for the grid. The input terminal T1*a* of the booster circuit 27*a* for the cathode and the input terminal T1*b* of the booster circuit 27*b* for the grid are respectively connected to the output terminal of the transformer circuit 24*a* for the cathode and that of the booster circuit 24*b* for the grid. The lead wires that are electroconductive members may be replaced by bus bars.

The lead wires 28*a*, 28*b* are bare metal wires that are not treated for insulation or not bare metal wires but held in a state of being capable of slightly conducting an electric current (namely in an uninsulated state). A lead wire normally shows a circular cross section. A bus bar shows a non-circular cross section (rectangular, elliptic, etc.) and is an oblong metal plate, an oblong metal rod or the like. A lead wire is made of metal that may typically be copper or a copper alloy. A bus bar generally shows a heat radiation effect due to the conduction higher than a lead wire.

The X-ray tube 7 and the booster circuits 27*a*, 27*b* arranged at predetermined respective positions on the base 2 are covered by a molded member M formed by way of a molding process. A molding process is a known process. It is a process where a fluid material to be molded is driven to flow into a mold and then solidified. The lead wire 28*a* connecting the cathode 11 and the output terminal T2*a* of the booster circuit 27*a* and the lead wire 28*b* connecting the grid 12 and the output terminal T2*b* of the booster circuit 27*b* are also covered by the molded member M.

If the molded member M contains one or more than one spaces or gaps in the inside, creeping discharges and/or corona discharges can take place there. Therefore, the fluid material to be molded is filled into a mold in such a way that no bubbles may appear in the molded member M during the molding process. While the molded member M is so formed as to cover all of the X-ray tub 7 and the booster circuits 27*a*, 27*b* for this embodiment, the minimal requirement to be satisfied for the purpose of the present invention is that the X-ray tube 7 is covered at a cathode side end part thereof and the lead wires 28*a*, 28*b* and the booster circuits 27*a*, 27*b* are covered at respective parts thereof at the high-voltage output terminal sections T2*a*, T2*b*, whichever appropriate by the molded member M. More specifically, in view of that a high-voltage sections that are not lower than 5 kV operate for electric discharges in the atmosphere, such high-voltage sections are covered by a molded member M in this embodiment.

The molded material of this embodiment is a material containing as principal ingredient an electrically insulating synthetic resin such as an epoxy-based or silicone-based synthetic resin that is made to contain a ceramic material such as aluminum nitride, alumina or silica and/or a heavy metal oxide such as $Bi_2O_3$ as filler. As a ceramic material and/or a heavy metal oxide is made to coexist in the molded member M as admixture, the molded member M shows not only an electrically insulating property but also an X-ray absorbing property.

For the purpose of raising the adhesiveness between the molded resin and the members to be covered by the molded member M, desirably the surfaces of the members to be covered by the molded member are washed well and a surface treatment agent referred to as primer is applied to the washed surfaces of the members to be covered by the molded member. When any of the materials of the related members does not show a satisfactory level of adhesiveness, the surface of the member of such a material that is to be covered by the molded member may be treated by sand blasting to make it coarse in order to physically raise the adhesiveness thereof. Such a treatment for producing a coarse surface is referred to as anchoring treatment.

The thermal conductivity of the molded member M can be raised by admixing ceramic to the material of the molded member M. The thermal conductivity of epoxy resin is 0.3 W/(m·K) in average. The thermal conductivity of silicon resin, that of aluminum nitride, that of alumina and that of silica are respectively 0.16, 300, 36.0 and 10.4 in average. Thus, it is important to increase the packing factor of ceramic or the like to raise the thermal conductivity. However, if a ceramic material is prepared as particles of a same particle size, the packing factor will be 74% at most for close packing where particles are held in contact. A maximum packing factor of, not less than 90% can be achieved by mixing particles of two or not less than three different sizes.

The X-ray absorbing property of the molded member M can be improved by admixing oxide of an element of an atomic number of not smaller than 55 (so-called heavy metal oxide) to the material of the molded member M. $Bi_2O_3$ which is oxide of an element of atomic number 83 belonging to the nitrogen group is employed in this embodiment.

An X-ray shielding member 29, which may typically be a thin sheet member made of lead, is arranged in a region corresponding to the X-ray tube 7 at the outside of the molded member M so as to cover the X-ray tube 7. Due to this arrangement, X-rays are prevented from leaking from the X-ray tube 7 to the outside. The X-ray shielding member 29 that is made of lead is very heavy and hence desirably the X-ray shielding member 29 is as small as possible from the viewpoint of moving the industrial X-ray generator 1.

Generally, the X-ray intensity I after passing through an X-ray shielding plate is expressed by $$I=I_0\exp(-\mu t)$$

and the transmission factor T is expressed by $$T=I/I_0=\exp(-\mu t),$$

where "μ" is the linear absorption coefficient (1/m) that is determined by the chemical composition and the density of the substance and "t" is the thickness (m) of the X-ray shielding plate.

When lead (Pb) is employed for an X-ray shielding plate, t=about 3.5 mm is required to make the transmission factor equal to 0.1% under energy of X-ray being 200 KeV. The transmission factor is a function of the thickness of the X-ray shielding plate and the area of the X-ray shielding plate can be reduced by reducing the distance from the X-ray source when the thickness of the X-ray shielding plate is unchangeable. The weight of the X-ray shielding plate can be reduced by reducing the area of the X-ray shielding plate. Because the molded member that is separated only by a small distance from the X-ray source is made to have an X-ray shielding property and the small molded member is covered by an X-ray shielding plate from the outside in this embodiment, the X-ray shielding plate can be made to have a small area and hence the weight of the X-ray shielding plate can be reduced. As a result, the overall weight of the industrial X-ray generator can be significantly reduced.

A thermal conductivity of not less than 10 W/(m·K) is selected for the molded member M of this embodiment. Thus, as a result, a situation where heat is accumulated in the inside of the industrial X-ray generator 1 to raise the temperature of the X-ray generator 1 to an unnecessary level is prevented from occurring.

Referring to FIG. 1, an outer case 31 is arranged at the outside of the molded member M. The outer case 31 is rigidly anchored onto the base 2 so as to entirely cover the molded member M. A handle 32 is fitted to the top wall of the outer case 31.

The operator of the industrial X-ray generator 1 carries the industrial X-ray generator 1 to an intended measuring site, holding the handle 32 by hand, and makes out a nondestructive examination there by means of X-rays.

In this embodiment, the X-ray tube 7 and the booster circuits 27*a*, 27*b* are covered by the molded member M and the power supply drivers 23*a*, 23*b*, the transformer circuits 24*a*, 24*b* and the controller 25 are stacked at the outside of the molded member M.

Only the parts subjected to a high voltage of not lower than 5 kV are covered by the molded member M. Since the above-mentioned stacked parts are low-voltage parts, they are not covered by the molded member M.

The parts that are shielded by the molded member M and the stacked parts are contained in the outer case 31 and the battery 22 to be used for both the cathode and the grid is arranged on the base 2 outside the outer case 31. The stacked circuit parts are exposed to the atmosphere and hence can give rise to electric discharges when dust gets in. Therefore, the outer case 31 is hermetically sealed. The battery 22 is removably mounted and when the power it stores is used up, it can be removed from the base 2 and charged by means of a battery charger (not shown).

Figure 5:
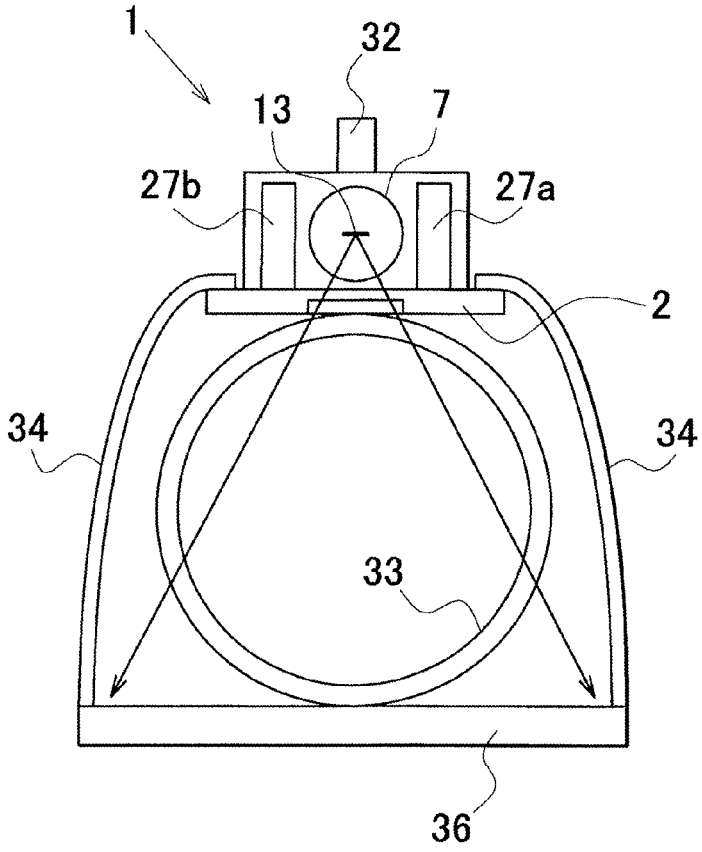
FIG. 5 is a schematic illustration of the industrial X-ray generator of FIG. 1 in an exemplary operation.

When making an examination, the industrial X-ray generator 1 is arranged in contact with the object of examination 33 as shown in FIG. 5, (which is a steel pipe in the instance of FIG. 5,) and a supporting member 34 is fitted to the fitting holes 3 (see FIG. 2) of the base 2. A two-dimensional X-ray detector 36 is supported in position by the supporting member 34 and the two-dimensional X-ray detector 36 is arranged at the position opposite to the X-ray generator 1 relative to the object of examination 33. The two-dimensional X-ray detector 36 may be formed by using an X-ray film, an imaging plate or a CCD (charge coupled device) detector.

Referring to FIG. 1, typically the outer diameter D of the X-ray tube 7 is 50 mm, the length L of the X-ray tube 7 is 170 mm and the height H of the molded member M is 70 mm. For the reasons that (1) electron emission not by thermo-electrons emission using a filament but by field emission is adopted, (2) the booster circuits 27*a*, 27*b* that are high-voltage components of the high-voltage power supply section are arranged adjacent to and along the opposite lateral sides of the X-ray tube 7 and (3) the output terminals T2*a*, T2*b* of the booster circuits 27*a*, 27*b* that are high-voltage components of the high-voltage power supply section are arranged at the cathode side end part of the X-ray tube 7 at corresponding positions, the cathode being a high-voltage part, and the other components of the high-voltage power supply section (namely, the battery 22, the power supply drivers 23*a*, 23*b*, the transformer circuits 24*a*, 24*b*, the controller 25, etc.) are collectively arranged near the anode side end part, or the grounding side, of the X-ray tube 7 and so on, the industrial X-ray generator 1 of this embodiment is very compact and lightweight when compared with conventional X-ray generators to realize an excellent portability.

Now, the circuit configuration of the high-voltage power supply section of this embodiment will be described below.

As describe earlier by referring to FIG. 1 and FIG. 2, a part of the high-voltage power supply section of this embodiment is arranged in the region 8*a* which is positioned in the vicinity of the end portion of the X-ray tube 7; the end portion corresponding to the anode 13. The other part of the high-voltage power supply section is arranged in the region 8*b* corresponding to the lateral side of the X-ray tube 7. The region 8*a* positioned near the end portion of the X-tray tube 7 corresponding to the anode 13 is a region that is held to the ground potential, while the region 8*b* at the lateral side of the X-ray tube 7 is a region where the electric potential rises from the ground potential to a high-voltage level.

Figure 6:
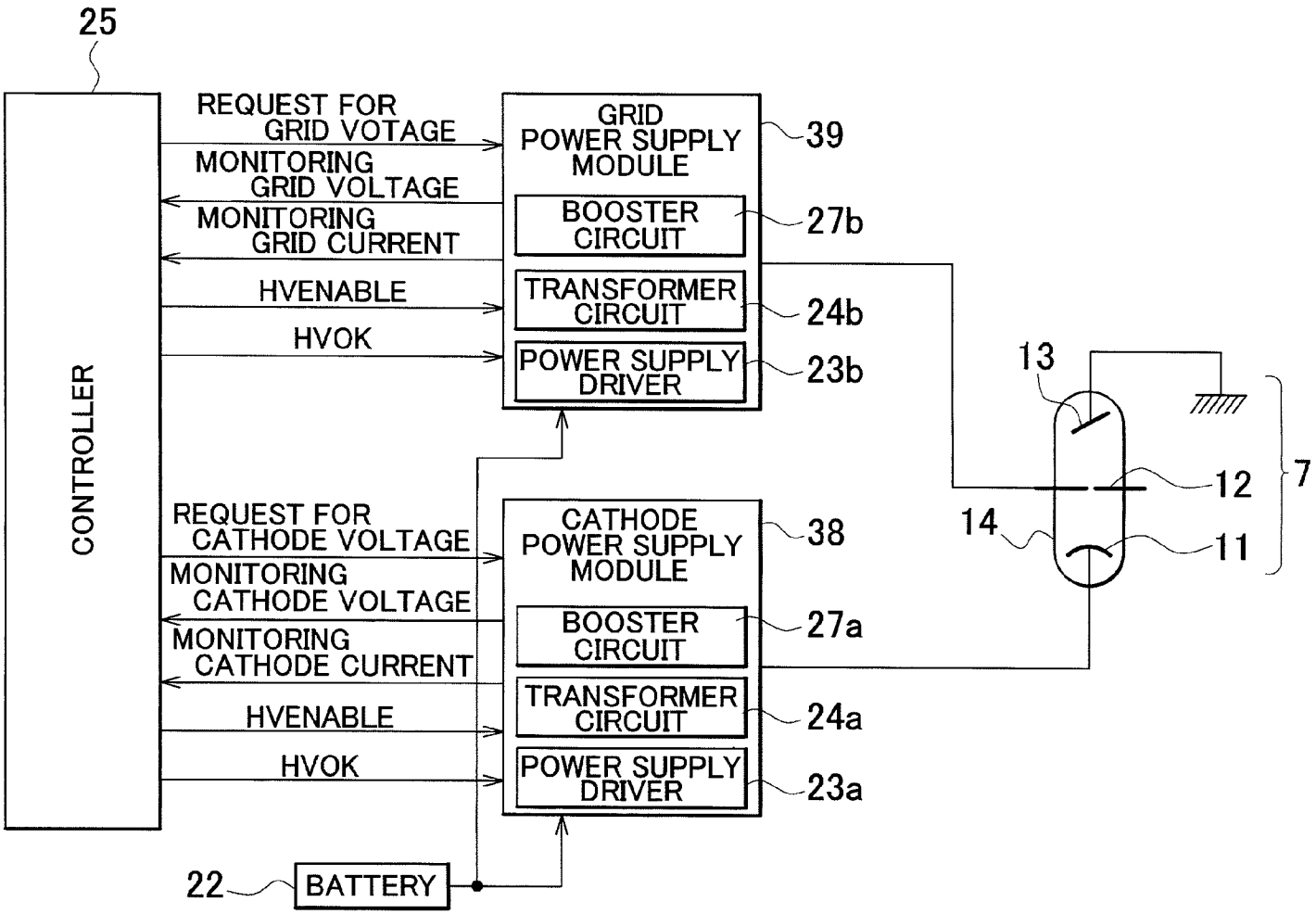
FIG. 6 is a block diagram of a control system that can be used for the industrial X-ray generator of FIG. 1.

FIG. 6 is a block diagram of the high-voltage power supply section of this embodiment, showing the circuit configuration thereof. The controller 22, the battery 22, the power supply driver 23*a* for the cathode, the transformer circuit 24*a* for the cathode, the booster circuit 27*a* for the cathode, the power supply driver 23*b* for the grid, the transformer circuit 24*b* for the grid and the booster circuit 27*b* for the grid are same as those illustrated in FIGS. 1, 2 and 4A and denoted by the same reference symbols.

A cathode power supply module 38 is formed by the power supply driver 23*a*, the transformer circuit 24*a* and the booster circuit 27*a* for the cathode. On the other hand, a grid power supply module 39 is formed by the power supply driver 23*b*, the transformer circuit 24*b* and the booster circuit 27*b* for the grid. The cathode power supply module 38 controls the voltage that is applied to the cathode 11, whereas the grid power supply module 39 controls the voltage that is applied to the grid 12. For example, the grid voltage is controlled to −100 kV and the cathode voltage is controlled to −200 kV. In this embodiment, the anode 13 (which is the target) is grounded.

Figure 7:
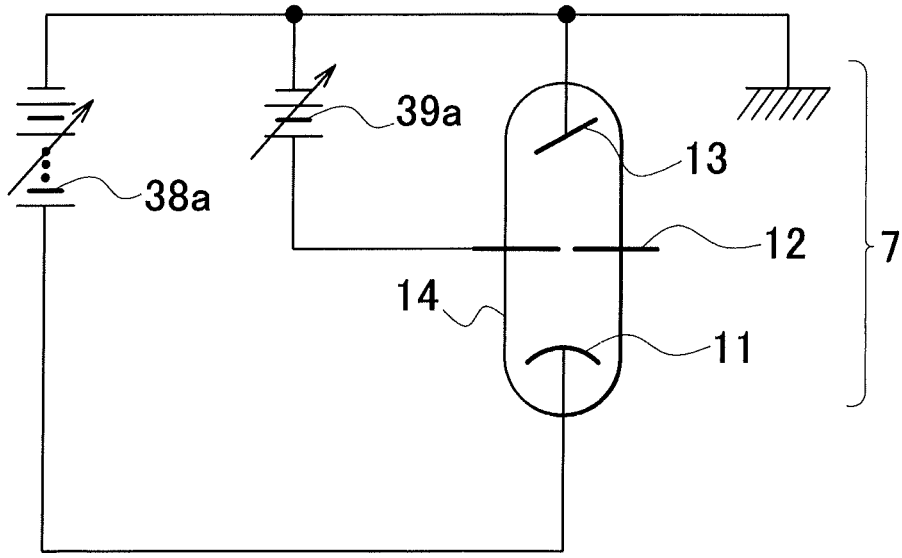
FIG. 7 is a circuit diagram of an equivalent circuit of block diagram of a control system of FIG. 6.

The block diagram of FIG. 6 is equivalent to the circuit diagram of FIG. 7. Namely, in the X-ray tube 7, a variable grid power supply 39*a* is arranged between the grounded anode 13 and the grid 12 and a variable cathode power supply 38*a* is arranged between the grounded anode 13 and the cathode 11.

Referring to FIG. 6, the controller 25 is formed by using a microcomputer having a CPU (central processing unit) and a memory.

The CPU realizes the function of controlling the operation of the cathode power supply module 38 and that of the grid power supply module 39 according to the program stored in the memory. More specifically, the CPU directs the level of the output voltage, the start of an operation and the end of an operation and monitors the actual voltage and the actual electric current.

Figure 8:
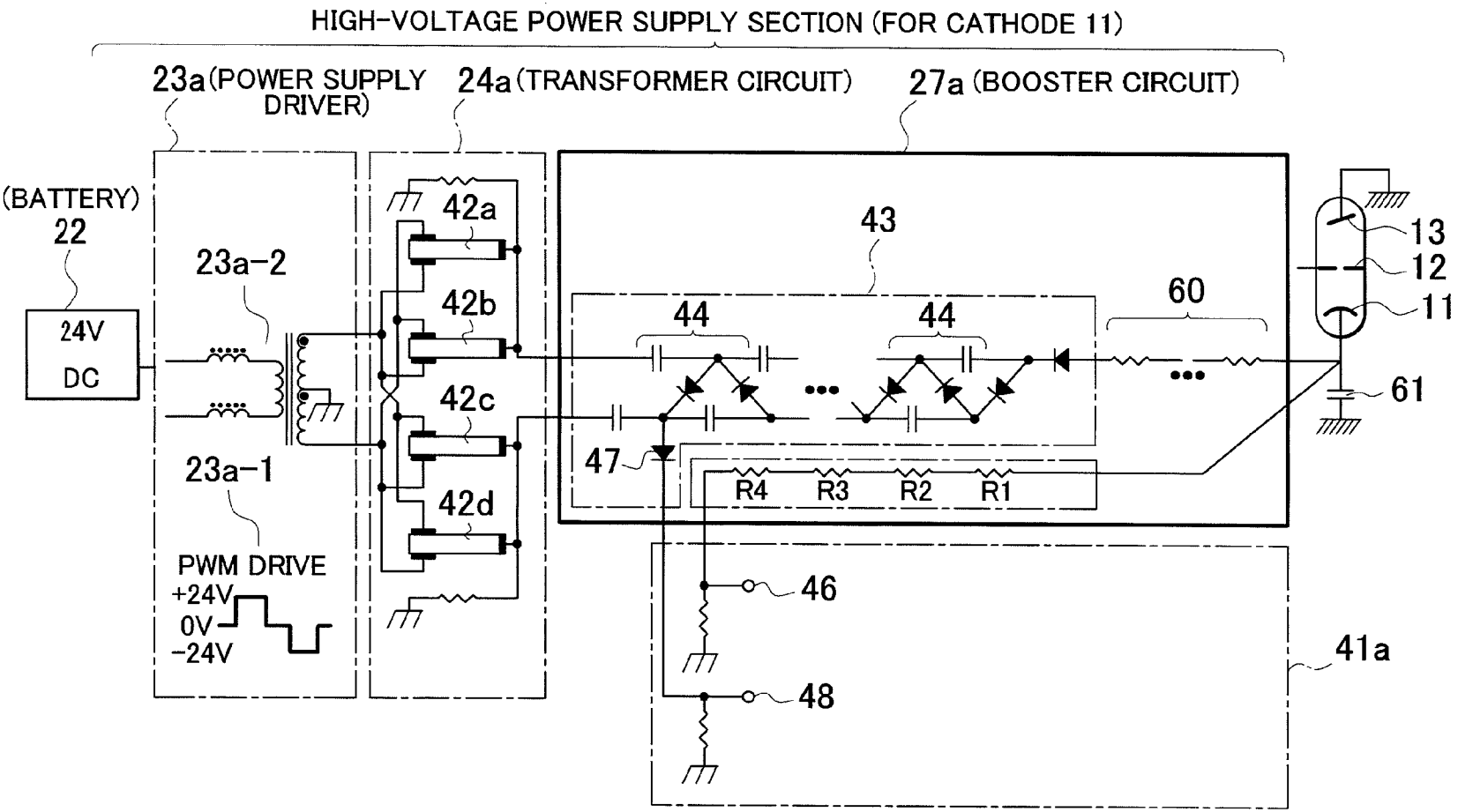
FIG. 8 is a circuit diagram of an embodiment of the block diagram of FIG. 6, showing the circuit configuration thereof.

FIG. 8 is a circuit diagram of an embodiment of high-voltage power supply section for supplying a high voltage, −200 kV for example, to the cathode 11, specifically showing the circuit configuration thereof. The configuration of the circuit for supplying a high voltage, −100 kV for example, to the grid 12 is basically same as the one shown in FIG. 8. The high-voltage power supply section for the cathode 11 is formed by the battery 22, the power supply driver 23*a*, the transformer circuit 24*a*, the booster circuit 27*a* and a monitor section 41*a*. Since the high-voltage power supply section for the grid 12 is formed in a similar manner, the high-voltage power supply section for the cathode 11 will be mainly described below also to cover the high-voltage power supply section for the grid 12.

The battery 22 typically outputs DC power of 24 V for example. The power supply driver 23*a* includes a PWM signal generator 23*a*-1 for generating a PWM (pulse width modulation) signal and a power supply section 23*a*-2 for generating a voltage corresponding to the PWM signal. Although not shown, the power supply driver 23*b* for the grid 12 has the same configuration. The power supply driver 23*a* generates high frequency power that matches the downstream transformer circuit 24*a* according to the voltage setting directive signal transmitted from the controller 25 by controlling the PWM (pulse width modulation).

The transformer circuit 24*a* includes a plurality of (four in this embodiment) piezoelectric transformers 42*a*, 42*b*, 42*c* and 42*d*. The piezoelectric transformers 42*a* to 42*d* are known transformer elements that can be formed by alternately laying a plurality of ceramic members having a piezoelectric effect and typically made of barium titanate or lead zirconate titanate and a plurality of metal electrodes and burning them. Lead zirconate titanate containing lead is employed for this embodiment.

As AC power of a frequency close to the resonance frequency is input to the input terminals of the piezoelectric transformers 42*a* to 42*d*, they outputs high frequency power of a voltage boosted by about 100 times to the output terminals thereof. As will be described hereinafter, the piezoelectric transformers 42*a* to 42*d* also has a function of preventing X-rays entering from the direction of the base 2 from getting into the controller 25, thereby preventing the controller 25 from operating erroneously under the influence of X-rays. In this embodiment, an output of 50 W can be obtained by using a plurality of small and low power consumption type piezoelectric transformers for cold-cathode tubes of LCD backlights rather than using large and high cost and high power type piezoelectric transformers. Thus, a small and low cost transformer circuits are formed by using such piezoelectric transformers. Power of about 4 to 8 kV is obtained at the output terminal of the transformer circuit 24*a* having such a configuration.

Figure 9:
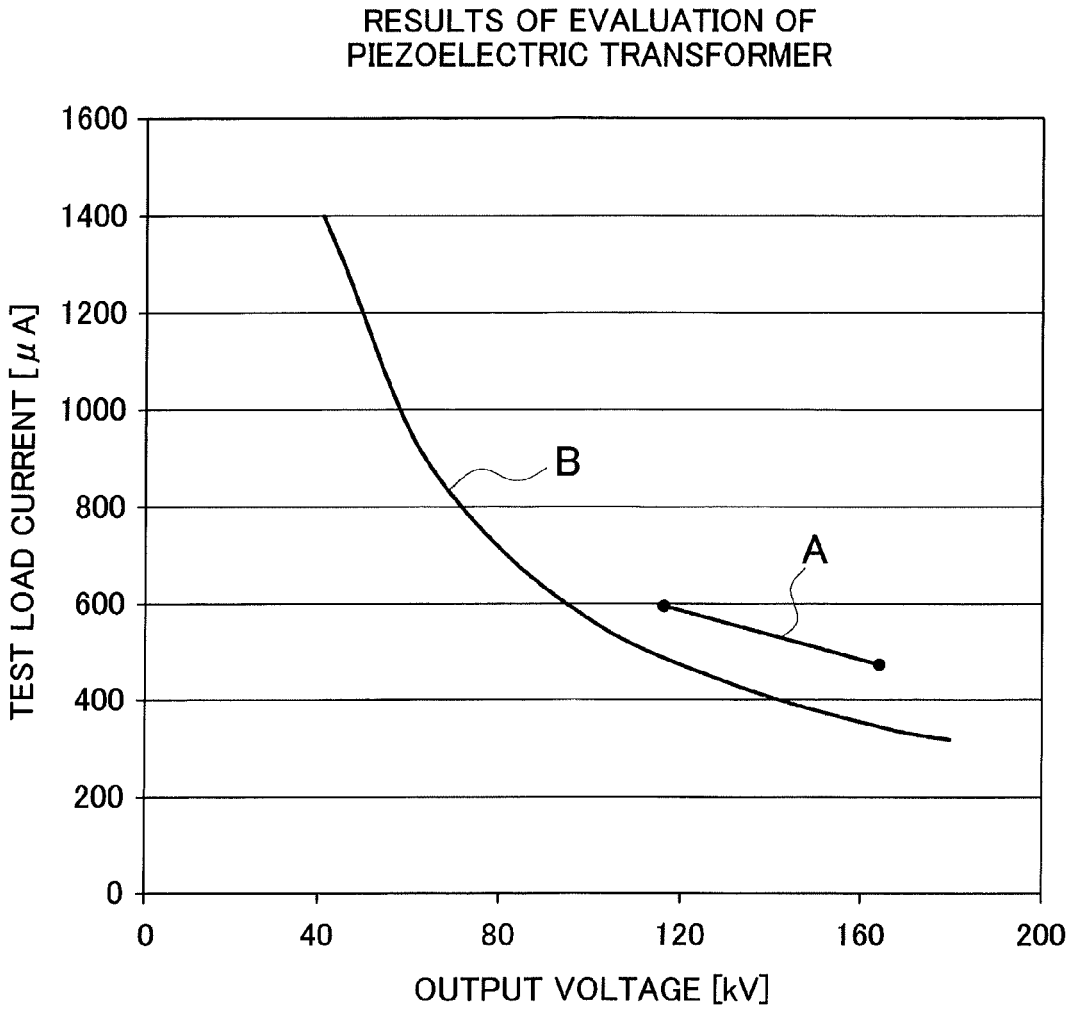
FIG. 9 is a graph illustrating the results of evaluation of the piezoelectric transformers that are main components of the circuit of FIG. 8.

FIG. 9 is a graph illustrating the results of evaluation of the piezoelectric transformers employed in this embodiment. In the graph, line segment A indicates the output characteristic of the piezoelectric transformers that are the objects of evaluation. Curved line B is a constant power curve that is obtained when target power is assumed to be 160 kV×50 W. It will be found that the piezoelectric transformers used in this embodiment are free from any problem in terms of characteristic because their performance is found in the region above the constant power curve.

Additionally, they are also free from any problem from the viewpoint of output voltage because an output voltage of about 160 kV is obtained.

Referring to FIG. 8, the high frequency output power of the transformer circuit 24*a* is input to the input terminal of the booster circuit 27*a*. In this embodiment, the booster circuit 27*a* is formed by using a Cockcroft-Walton circuit 43. The Cockcroft-Walton circuit 43 itself is a known booster circuit that is formed by connecting a plurality of boosting steps 44 in series, each of which is formed by bridge-connecting two capacitors and two diodes.

The Cockcroft-Walton circuit 43 of this embodiment is designed to boost and double a voltage by a single boosting step 44. The high frequency output power of the transformer circuit 24*a* that is about 4 to 8 kV is boosted to a DC high voltage of 200 kV by sequentially connecting tens of several boosting steps 44. The output terminal of the Cockcroft-Walton circuit 43 is connected to the cathode 11 by way of a limiting resistor 60. Since the anode 13 of this embodiment is grounded, the cathode 11 is held to a high negative voltage. Referring to FIG. 2, a low voltage is input to the input terminal T1*a* of the booster circuit 27*a* for the cathode before it is boosted and a boosted high voltage is output to the output terminal T2*a*.

Referring to FIG. 8, resistors R1, R2, R3 and R4 for voltage monitoring are connected in series to the lead wire from the cathode 11. The voltage lowered by these resistors is measured at the voltage monitoring terminal 46. On the other hand, the electric current taken out by way of diode 47 is measured at the current monitoring terminal 48. The measurement data are then transmitted to the controller 25 shown in FIG. 6 as control data.

A ripple filter 61 is connected to the cathode 11. The ripple filter 61 reduces the ripples produced from the high-voltage power supply. Since it is difficult to install a compact and high withstand voltage capacitor near the cathode 11, the ripple filter 61 is formed by arranging an electrode 62 outside the cathode 11 with the molded member M of an appropriate size disposed in-between, thereby forming a parallel flat plate type capacitor.

More specifically, the dielectric breakdown voltage of the molded resin member is made equal to about 25 kV/mm and the dielectric constant thereof is made equal to about 3.5, while the thickness of the molded resin member is made equal to 10 mm at the cathode 11 side. Then, a capacitor having a withstand voltage of 250 kV and an electrostatic capacitance of 8.5 pF is arranged by arranging an electrode 62 having an area of 250 $mm^2$ at the outside thereof.

Referring to FIG. 4A, the capacitors 51 (ceramic capacitors in this embodiment) and the diodes 52 that form the booster circuit 27*a* for the cathode are arranged in the longitudinal direction from side of the base 2 toward the side of the handle 32. The voltage monitoring resistors R1 to R4 shown in FIG. 8 are arranged also in the longitudinal direction in a similar manner. These capacitors 51 are electrically connected by arranging them flexibly and three-dimensionally and solder-bonding them with use of connecting jig without using any circuit substrate. This arrangement is adopted because they may not be broken by contraction when the molded member is cured and/or by thermal expansion and thermal contraction due to rises and falls of temperature in operation.

Figure 4B:
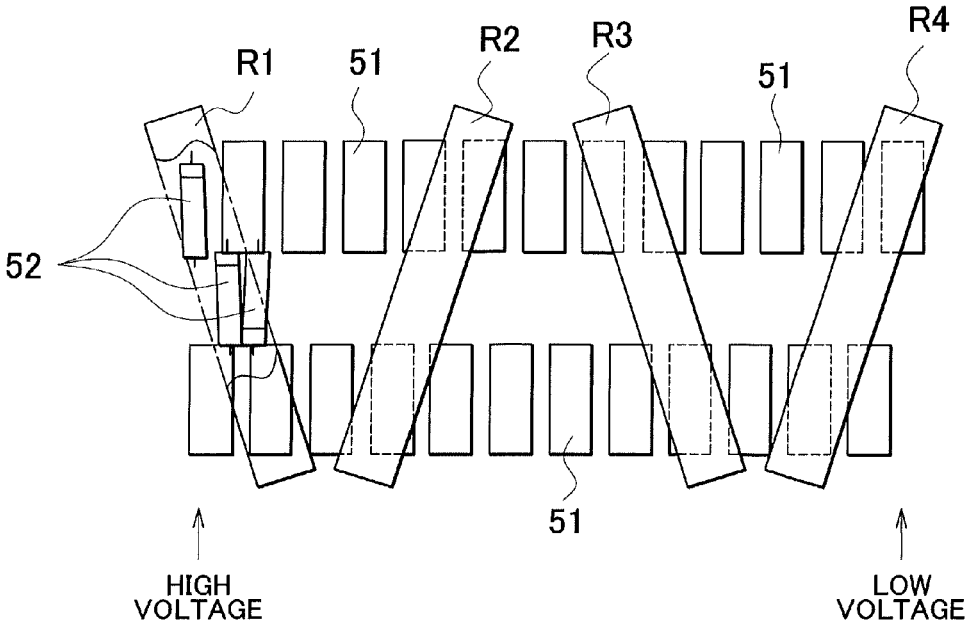
FIG. 4B is a schematic illustration of the components of the booster circuit as viewed in the direction of arrow E in FIG. 4A.

When these electronic components are viewed in the cross section as shown in FIG. 1 in the direction of arrow E in FIG. 4A, the resistors R1 to R4 are sequentially and obliquely arranged from the high-voltage side, while capacitors 51 are arranged in two rows including an upper row and a lower row as shown in FIG. 4B and a plurality of diodes 52 are connected to the input and output terminals of each capacitor 51. In FIG. 4, only three diodes connected to the leftmost capacitor are shown and all the other diodes are omitted.

As described above, the electronic components of the booster circuit 27*a* for the cathode are so arranged as to effectively exploit the vertical space in the industrial X-ray generator 1.

They are also transversally intensively arranged in a very narrow region to provide a great advantage for downsizing the industrial X-ray generator 1.

The booster circuit 27*b* for the grid arranged at the side opposite to the booster circuit 27*a* for the cathode relative to the X-ray tube 7 is formed by electronic components similar to those of the booster circuit 27*a* for the cathode. However, note that, since the high-voltage level that is ultimately required to the cathode 11 differs from the voltage level required to the grid 12, the number of electronic components differs between the booster circuits. The configuration of the booster circuit 27*b* for the grid may easily be understood by seeing the configuration of the booster circuit 27*a* for the cathode and hence will not be described any further.

How to operate the industrial X-ray generator 1 is described above by referring to FIG. 5. High energy X-rays are emitted from the X-ray generator 1 of this embodiment toward the object of examination 33. For example, high energy X-rays of about 160 kV will be emitted. Then, scattering X-rays and fluorescent X-rays are relatively highly intensely produced from the object of examination 33 and can be irradiated to the electronic circuit parts arranged in the region 8*a* shown in FIG. 1. If X-rays are irradiated onto the controller 25, the CPU, the memory and other components in the inside of the controller 25 can fall into operation errors.

However, the transformer circuits 24*a* and 24*b* are arranged below the controller 25 in this embodiment and the piezoelectric transformers 42*a* to 42*d* that are components of these transformer circuits contain lead as a material. Lead has a property of shielding X-rays so that scattering X-rays and fluorescent X-rays are prevented from being irradiated onto the controller 25 by the transformer circuits 24*a* and 24*b* arranged below the controller 25 and therefore, the controller is prevented from falling into operation errors.

Additionally, as the piezoelectric transformers are arranged as X-ray shielding elements, the use of lead plates for shielding X-rays can be reduced so much to provide a great advantage of reducing the weight of the X-ray generator.

In this embodiment, the X-ray tube 7 and the booster circuits 27*a* and 27*b* (that is, high-voltage power supply section) are connected almost directly by means of electroconductive members such as lead wires or bus bars without using bulky connectors for high-voltage applications and insulated by the molded member M.

As a result, the industrial X-ray generator is downsized and made lightweight.

(Modified Embodiment)

Figure 10:
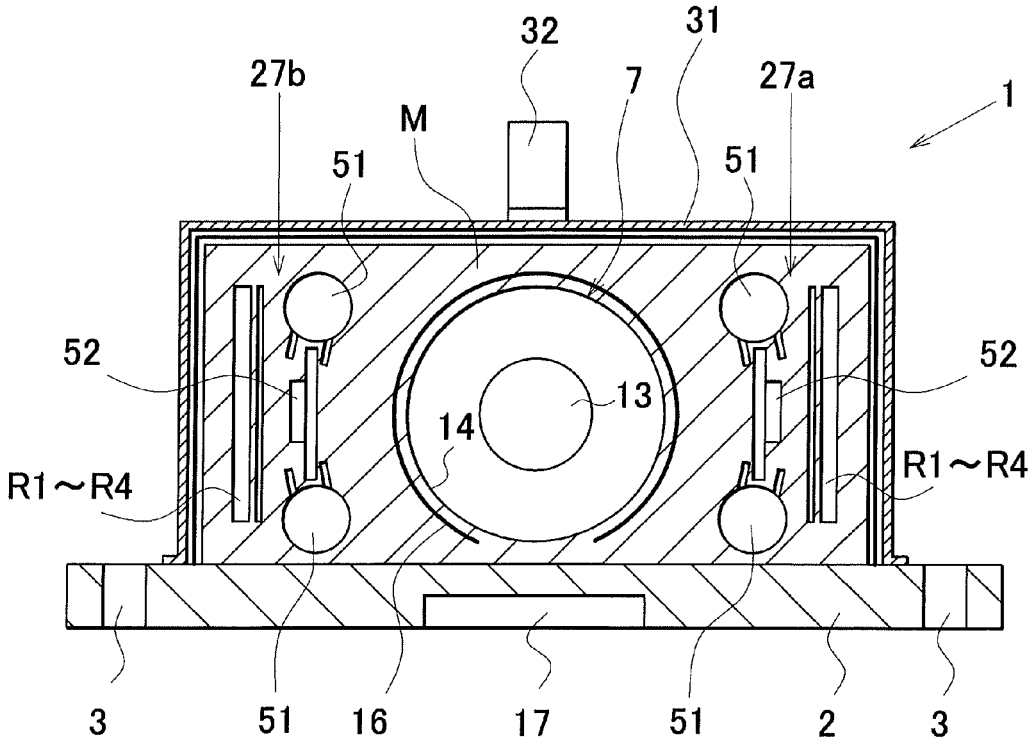
FIG. 10 is a schematic cross-sectional lateral view of another embodiment of industrial X-ray generator according to the present invention.

FIG. 10 illustrates an arrangement of the ceramic capacitors 51, the diodes 52 and the resistors R1 to R4 of the booster circuit 27*a* for the cathode and the booster circuit 27*b* for the grid that is different from the arrangement shown in FIG. 4A. With this modified arrangement, the ceramic capacitors 51 are obliquely arranged in the vertical direction so that this modified embodiment is slightly taller than the embodiment shown in FIG. 4A but the transversal dimensions thereof are greatly reduced from the embodiment of FIG. 4A.

(Second Embodiment of Industrial X-Ray Generator)

Figure 11:
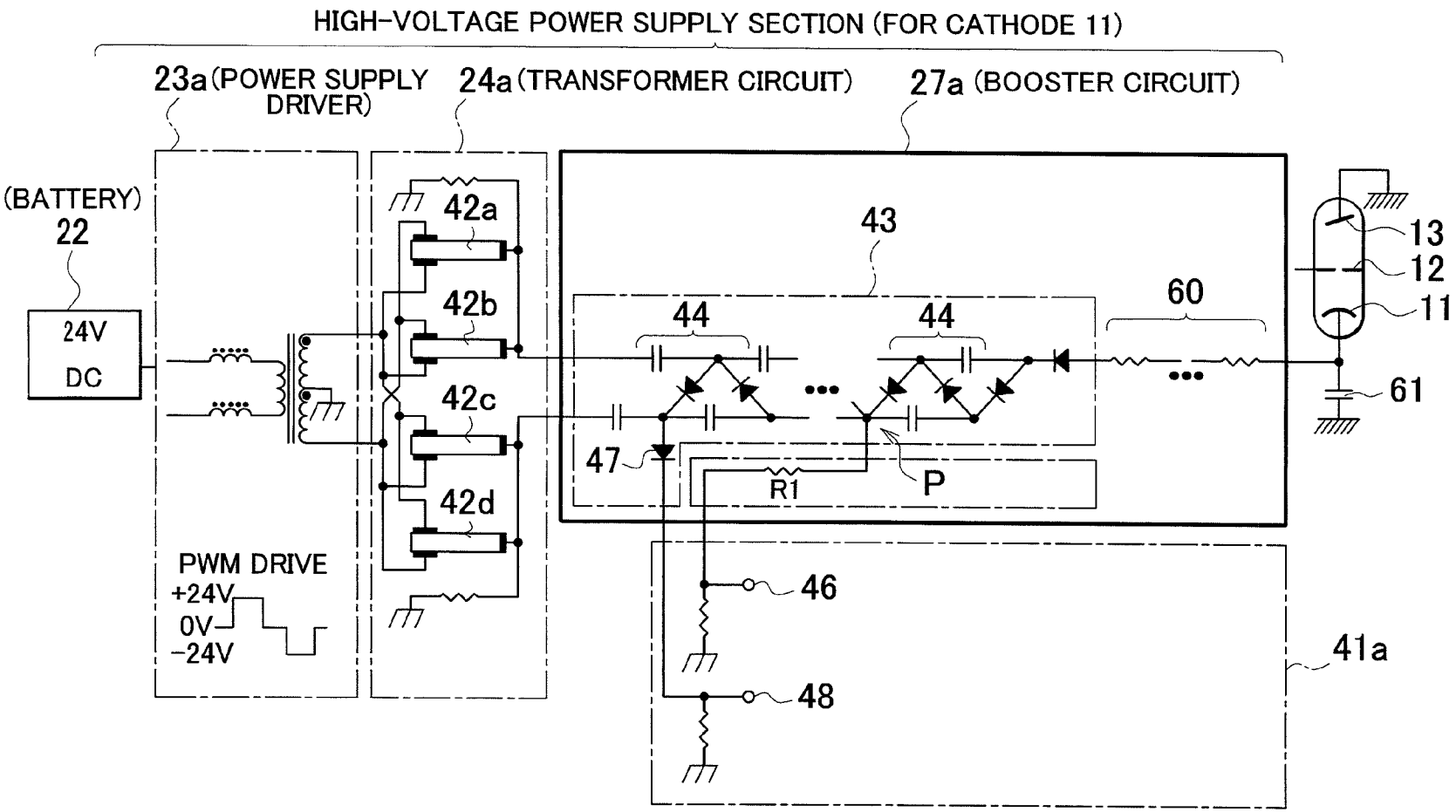
FIG. 11 is a circuit diagram of the high-voltage power supply section of still another embodiment of industrial X-ray generator according to the present invention.

FIG. 11 illustrates the high-voltage power supply section of another embodiment of industrial X-ray generator according to the present invention. Now, this embodiment will be described below.

The resistors R1, R2, R3 and R4 for voltage monitoring are connected in series to the lead wire from the cathode 11 in the high-voltage power supply section of the embodiment shown in FIG. 8. The applied high voltage is lowered by these resistors and the lowered voltage is measured at the voltage monitoring terminal 46. The measurement data are transmitted to the controller 25 shown in FIG. 6 and used by the controller 25 as control data. In short, the voltage measurement circuit that includes the resistors R1, R2, R3 and R4 measures the voltage at the final stage of the Cockcroft-Walton circuit 43 in the embodiment shown in FIG. 8.

On the other hand, in the high-voltage power supply section of the embodiment shown in FIG. 11, a voltage measurement circuit that includes a single resistor R1 or a plurality of resistors connected in series measures the voltage at an intermediate position P between the input end and the output end of Cockcroft-Walton circuit 43. The measured values are transmitted to the controller 25 same as the one shown in FIG. 6 and used as control data. The intermediate position P can be determined by seeing the withstand voltage of the resistor R1 to be used in this embodiment. For example, if an ordinary resistor is used as resistor R1, a position that shows an electric potential of about 30 kV can be selected for the position P. Generally, a position that shows an electric potential equal to ½ of the electric potential at the final stage of the Cockcroft-Walton circuit 43 is preferably selected.

With this embodiment, the number of resistors that are used in FIG. 4B can be reduced to one. In other words, only resistor R1 is employed in this embodiment. Then, the X-ray generator can be further downsized and made lightweight. Note that all the arrangement of this embodiment other than the high-voltage power supply section shown in FIG. 11 is same as the embodiment shown in FIGS. 1, 2, 3, 4, 5, 6, 7 and 9.

(Third Embodiment of Industrial X-Ray Generator)

Figure 12:
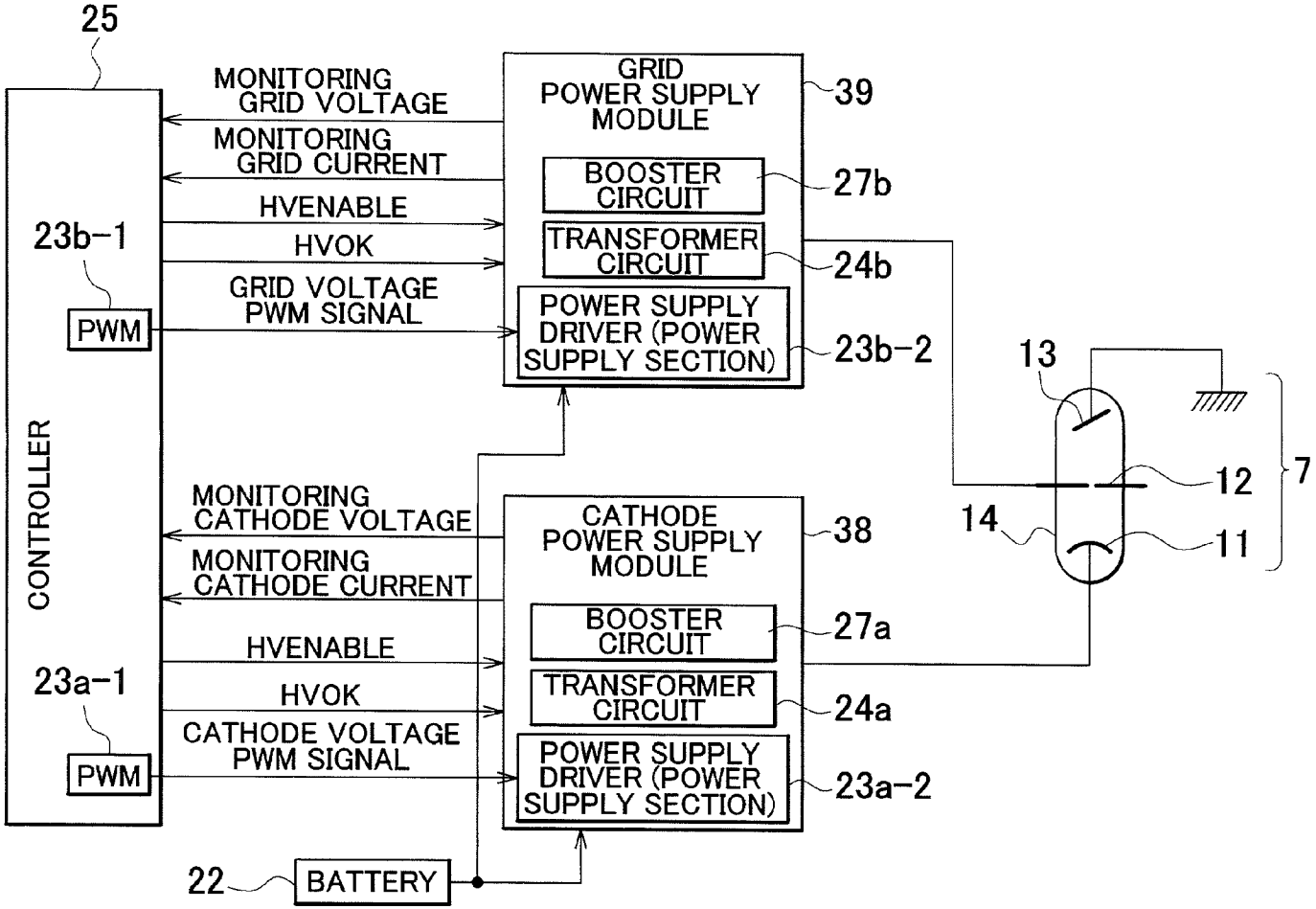
FIG. 12 is a block diagram of the control system of still another embodiment of industrial X-ray generator according to the present invention.
Figure 13:
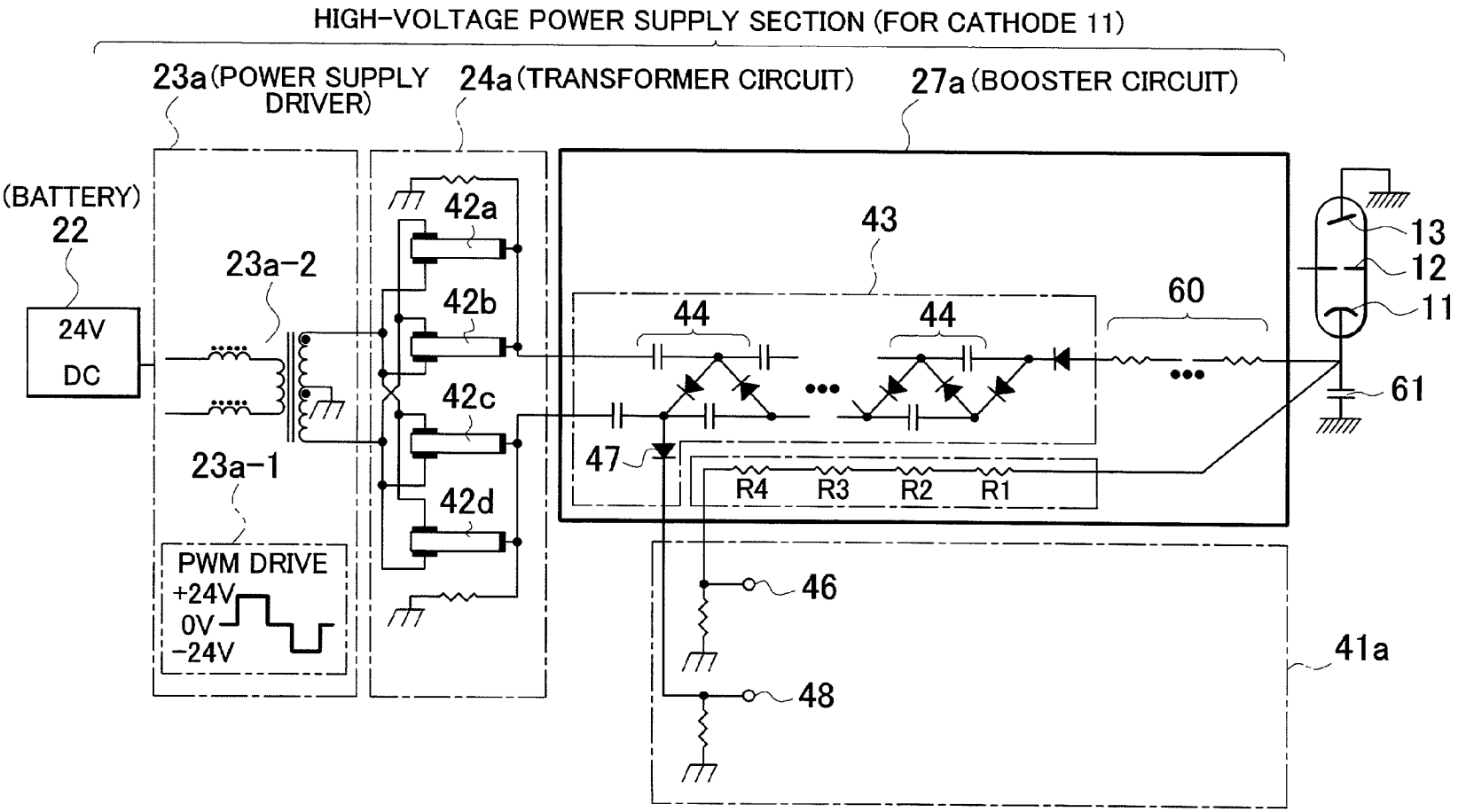
FIG. 13 is a circuit diagram showing a part of FIG. 12 in greater detail.

FIGS. 12 and 13 show a still another embodiment of industrial X-ray generator according to the present invention. To be more specific, FIG. 12 is a block diagram of the control system of this embodiment and FIG. 13 shows an exemplary circuit diagram that can be used for the block diagram of FIG. 12. Hereinafter, this embodiment will be described.

The power supply driver 23*a* contains a PWM signal generator 23*a*-1 and a power supply section 23*a*-2 in the high-voltage power supply section of the embodiment shown in FIGS. 6 and 8. The controller 25 issues a voltage setting directive signal to both the grid power supply module 39 and the cathode power supply module 38. Then, a PWM signal is output from the PWM signal generator 23*a*-1 according to the voltage setting directive signal and a voltage is output from the power supply section 23*a*-2 according to the PWM signal.

Now, while in the high-voltage power supply section of this embodiment shown in FIGS. 12 and 13, the power supply driver 23*a* also includes a PWM signal generator 23*a*-1 and power supply section 23*a*-2, the power supply sections 23*a*-2 and 23-*b* are arranged upstream relative to the transformer circuits 24*a* and 24*b* and the PWM signal generators 23*a*-1 and 23*b*-1 are contained in a controller 25 that includes an MCU (micro control unit).

In this embodiment, signals for pulse width modulation, or PWM signals, are output respectively from the PWM signal generators 23*a*-1 and 23*b*-1 contained in the controller 25 to the power supply modules 38 and 39. As the controller 25 is made to generate PWM signals in this way, the system delay of the control loop can be reduced to improve the stability of both voltage and electric current. Note that all the arrangement of this embodiment other than the high-voltage power supply section shown in FIGS. 12 and 13 is same as the embodiment shown in FIGS. 1, 2, 3, 4, 5, 7 and 9.

(Fourth Embodiment of Industrial X-Ray Generator)

Figure 14:
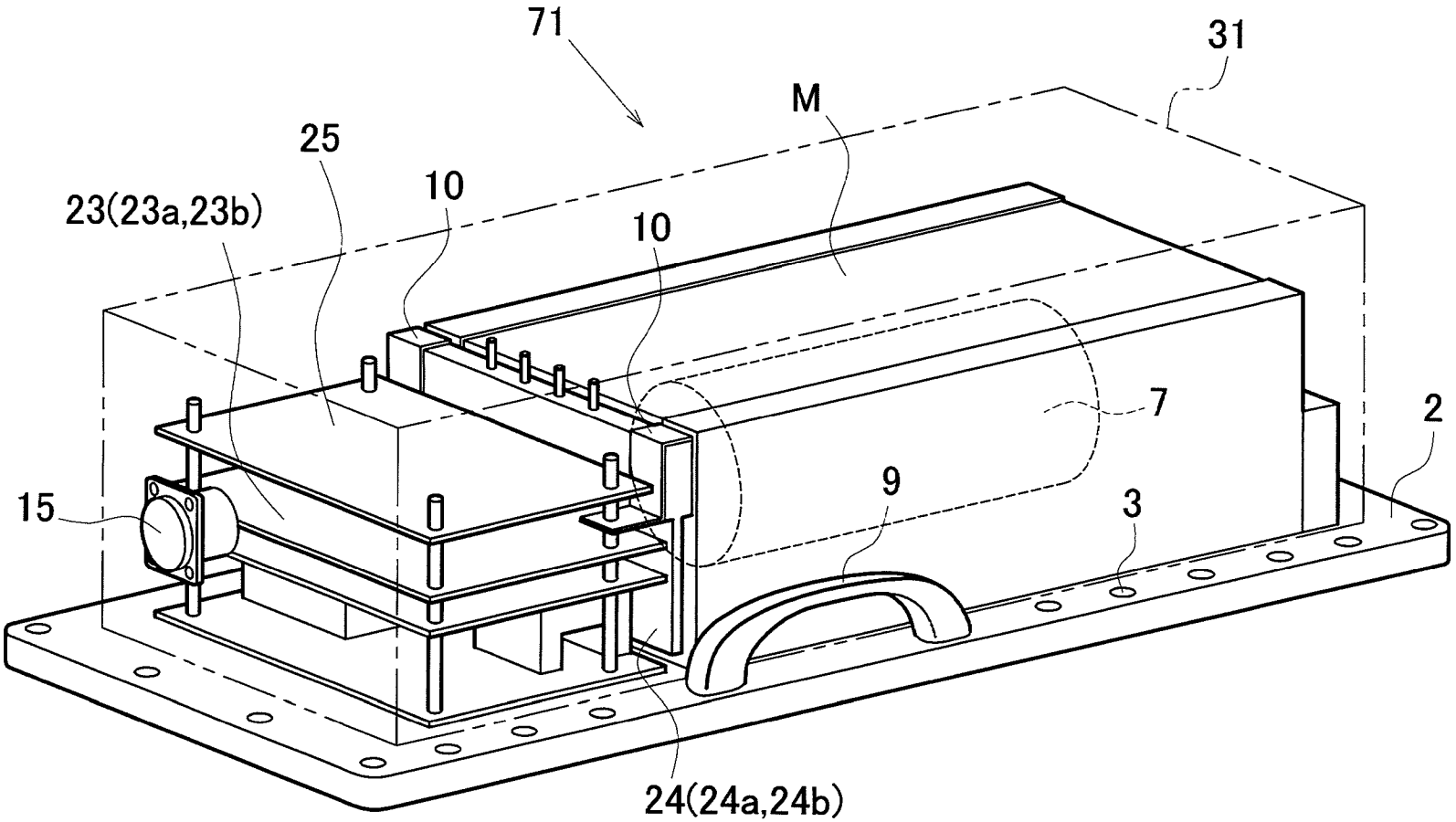
FIG. 14 is a schematic perspective view of still another embodiment of industrial X-ray generator according to the present invention, showing how it structurally appears from the outside.

FIG. 14 is a schematic perspective view of still another embodiment of industrial X-ray generator according to the present invention, showing how it structurally appears from the outside. Now, this embodiment will be described below.

In the embodiment shown in FIG. 1, the power supply driver 23*a* for the cathode, the power supply driver 23*b* for the grid, the transformer circuit 24*a* for the cathode, the transformer circuit 24*b* for the grid and the controller 25 are sequentially stacked on the base 2 with their substrates extending horizontally relative to the base 2. On the other hand, in the industrial X-ray generator 71 of this embodiment shown in FIG. 14, power supply driver 23*a* for the cathode and power supply driver 23*b* for the grid are mounted on a driver substrate 23 that is a single circuit substrate and the driver substrate 23 and controller 25 are sequentially stacked.

Meanwhile, transformer circuit 24*a* for the cathode and transformer circuit 24*b* for the grid are mounted on a transformer substrate 24 that is a single circuit substrate and the transformer substrate 24 is arranged vertically (namely orthogonally or substantially orthogonally relative to the stacked structure of the controller 25 and other components) between the stacked structure and a molded member M. The molded member M contains an X-ray tube 7 in the inside.

Differently stated, the power supply drivers 23*a*, 23*b* and the controller 25 are arranged horizontally and stacked to form a structure, which is then arranged at a side of the X-ray tube 7 with a space interposed between them. The transformer circuits 24*a*, 24*b* are arranged vertically in the space to spatially shield the structure and the X-ray tube 7.

FIG. 14 shows a base 2, a handle 9, a metal fitting 10, an external power supply connector 15 and an outer case 31. Note that all the arrangement of this embodiment other than the appearance structure shown in FIG. 14 is same as the embodiment shown in FIGS. 3, 4, 5, 6, 7, 8 and 9.

Thus, this embodiment can continuously raise a voltage from a low voltage to an intermediate voltage and to a high voltage and those voltages can be reliably insulated from each other with ease. Additionally, as the transformer substrate 24 including piezoelectric transformers that contain lead is vertically arranged between the stacked substrate section and the molded member M, the X-rays produced from the X-ray tube 7 can be absorbed by the transformer substrate 24. Then, the X-rays are prevented from irradiating the semiconductor devices included in the controller 25. As a result, it is possible to reduce the risk of operation errors of the semiconductor devices due to X-rays.

(Other Embodiments)

The present invention is described above by way of preferred embodiments. However, the present invention is by no means limited to the above-described embodiments, which may be altered and modified without departing from the scope of the present invention as defined by the appended claims.

For example, while a cathode 11 is formed by a field emission type electron generating member in each of the above-described embodiments, it may be replaced by a thermal electron generation type electron generating member such as a filament.

What is claimed is:

1. An industrial X-ray generator comprising:

an X-ray tube that stores a cathode for emitting electrons and an anode for attracting electrons in a tubular body thereof;

an X-ray shielding member that is made of a substance mainly containing an element of an atomic number not smaller than 55 and hardly allowing X-rays to pass through the substance and covers the X-ray tube; a booster circuit that generates a high voltage to be applied to the cathode;

the anode being grounded, the booster circuit being formed by sequentially connecting a plurality of boosting steps extending from a low-voltage terminal to a high-voltage terminal of its own, the booster circuit being arranged in a lateral region of the X-ray tube so as to make the low-voltage terminal of its own correspond to the anode of the X-ray tube and the high-voltage terminal of its own correspond to the cathode of the X-ray tube, an electroconductive member extending from the cathode to the outside of the X-ray tube and connected to the high-voltage terminal of the booster circuit; and a molded member containing insulating resin and formed to shield at least a cathode side end part of the X-ray tube, the electroconductive member extending from the cathode side end part and at least a high-voltage terminal side end part of the booster circuit.

2. The industrial X-ray generator according to claim 1, further comprising:

a transformer circuit including piezoelectric transformers supplying electric power to the low-voltage terminal of the booster circuit; and a power supply driver for supplying AC power of a frequency suited to the piezoelectric transformers to the transformer circuit.

3. The industrial X-ray generator according to claim 2, wherein the power supply driver and the transformer circuit are arranged near the anode side end part of the X-ray tube.

4. The industrial X-ray generator according to claim 2, further comprising:

a controller for controlling the operation of the booster circuit, that of the transformer circuit and that of the power supply driver, the transformer circuit being arranged adjacently relative to the controller.

5. The industrial X-ray generator according claim 4, further comprising a base for mounting the X-ray tube, the power supply driver being mounted on the base, the transformer circuit being mounted on the power supply driver, the controller being arranged on the transformer circuit.

6. The industrial X-ray generator according to claim 1, wherein a capacitor is connected to the cathode by arranging an electrode for the cathode by way of the molded member having a predetermined width.

7. The industrial X-ray generator according to claim 1, wherein the booster circuit includes a Cockcroft-Walton circuit.

8. The industrial X-ray generator according to claim 1, wherein the molded member contains an oxide of an element of an atomic number not smaller than 55 as filler.

9. The industrial X-ray generator according to claim 1, wherein the thermal conductivity of the molded member is not less than 10 W/(m·K).

10. The industrial X-ray generator according to claim 1, wherein the cathode emits electrons on the basis of field emission.

11. The industrial X-ray generator according to claim 4, wherein a voltage measurement circuit for measuring the voltage at an intermediate position between the input end and the output end of the plurality of boosting steps is provided, and the output voltage of the voltage measurement circuit is transmitted to the controller so as to be used as information for control operations.

12. The industrial X-ray generator according to claim 4, wherein the power supply driver includes a PWM signal generating section for outputting a PWM signal that is a signal for pulse width modulation and a power supply section for generating a voltage according to the PWM signal, the power supply section is arranged upstream relative to the transformer circuit and the PWM signal generating section is arranged in the inside of the controller, and the controller generates a PWM signal and the power supply section generates a voltage according to the PWM signal.

13. The industrial X-ray generator according to claim 4, wherein a structure formed by stacking the power supply driver and the controller is arranged at a side of the X-ray tube with a space interposed between them, and the transformer circuit is arranged in the space to spatially shield the structure and the X-ray tube.

14. The industrial X-ray generator according to claim 3, further comprising:

a controller for controlling the operation of the booster circuit, that of the transformer circuit and that of the power supply driver, the transformer circuit being arranged adjacently relative to the controller.

15. The industrial X-ray generator according claim 14, further comprising a base for mounting the X-ray tube, the power supply driver being mounted on the base, the transformer circuit being mounted on the power supply driver, the controller being arranged on the transformer circuit.

16. The industrial X-ray generator according to claim 15, wherein a capacitor is connected to the cathode by arranging an electrode for the cathode by way of the molded member having a predetermined width.

17. The industrial X-ray generator according to claim 16, wherein the booster circuit includes a Cockcroft-Walton circuit.

18. The industrial X-ray generator according to claim 17, wherein the molded member contains an oxide of an element of an atomic number not smaller than 55 as filler.

19. The industrial X-ray generator according to claim 18, wherein the thermal conductivity of the molded member is not less than 10 W/(m·K).

20. The industrial X-ray generator according to claim 19, wherein the cathode emits electrons on the basis of field emission.

* * * * *